United States Patent [19]

Pfeiffer et al.

[11] Patent Number: 5,011,433

[45] Date of Patent: Apr. 30, 1991

[54] MULTIPOLE CONNECTOR FOR CONTROL DEVICES IN UNDERGROUND WORKING

[75] Inventors: Otmar Pfeiffer; Guy Geuns; Josef Welzel, all of Wuppertal, Fed. Rep. of Germany

[73] Assignee: Hermann Hemscheidt Maschinenfabrik GmbH & Co., Wuppertal, Fed. Rep. of Germany

[21] Appl. No.: 422,537

[22] Filed: Oct. 17, 1989

[30] Foreign Application Priority Data

Oct. 20, 1988 [DE] Fed. Rep. of Germany ..... 3835756

[51] Int. Cl.[5] ..... H01R 13/44; H01R 13/52

[52] U.S. Cl. ..... 439/589; 439/279; 439/587

[58] Field of Search ..... 439/278, 279, 547, 548, 439/587–589, 598

[56] References Cited

U.S. PATENT DOCUMENTS 3,290,639 12/1966 Driemeyes ..... 439/589
4,632,482 12/1986 Punako et al. ..... 439/587
4,734,057 3/1988 Noschese ..... 439/589
4,758,174 7/1988 Michaels et al. ..... 439/589
4,795,360 1/1989 Newman et al. ..... 439/279
4,836,791 6/1989 Grable et al. ..... 439/81

*Primary Examiner*—Paula A. Bradley
*Attorney, Agent, or Firm*—Berman, Aisenbert & Platt

[57] ABSTRACT

A multipole connector in the form of a sealed lead-through for fitting through a wall of a casing of a control device used for underground working, comprising a contact-holder secured via securing parts in sealing-tight manner in an opening in the wall and having a number of contact chambers extending through the contact holder parallel to one another in the direction of the longitudinal axis of the connector, each contact chamber containing contact elements which have connecting pieces which project outwards from one side of the contact holder for the purpose of making connections, characterized in that the connecting pieces of the contact elements comprise parallel soldering taps.

12 Claims, 3 Drawing Sheets

MULTIPOLE CONNECTOR FOR CONTROL DEVICES IN UNDERGROUND WORKING

The invention relates to a multipole connector in the form of a sealed lead-through for fitting through a wall of a casing of a control device used for underground working, comprising a contact-holder secured via securing parts in sealing-tight manner in an opening in the wall and having a number of contact chambers extending through the contact holder parallel to one another in the direction of the longitudinal axis of the connector, each contact chamber containing contact elements which have connecting pieces which project outwards from one side of the contact holder for the purpose of making connections.

In underground working, electrohydraulic control devices are used e.g. for controlling self-advancing support units, and the control devices of neighbouring support units are interconnected by cables. The cables are connected by multipole connectors of the kind according to the preamble, each control device having two connectors.

A disadvantage of known connectors is that it is very complicated to connect the line connections inside the device, since individual wires of a bundle combined into a cable harness each have to be separately connected to the connecting pieces of the contact elements, more particularly by soldering.

The object of the invention therefore is to improve the known connectors so that a connection inside the apparatus via the connecting pieces of the contact elements is greatly simplified.

To this end according to the invention the connecting pieces cf the contact elements comprise parallel soldering taps. As a result, "flexible printed circuit boards" can be used as internal line connections, and it is only necessary for the soldering tabs according to the invention to be inserted through openings in the circuit boards and then soldered. In addition, all the connecting points can be soldered simultaneously in a soldering bath in known manner. The invention therefore saves considerable time in connecting the connectors.

Advantageously, in order to insert the soldering tabs into the openings in the circuit boards, the soldering tabs project for varying lengths from the contact holder. More particularly, the free ends of the soldering tabs end approximately on a plane disposed at an angle to the longitudinal axis of the multipole connector. The soldering tabs can therefore be inserted singly or in groups successively through the corresponding soldering openings, and the position can easily be corrected if required by slightly bending the soldering tabs.

Other advantageous embodiments of the invention are contained in the sub-claims and in the description hereinafter.

The invention will now be explained in detail with reference to the drawings, in which.

Figures 1, 1A:
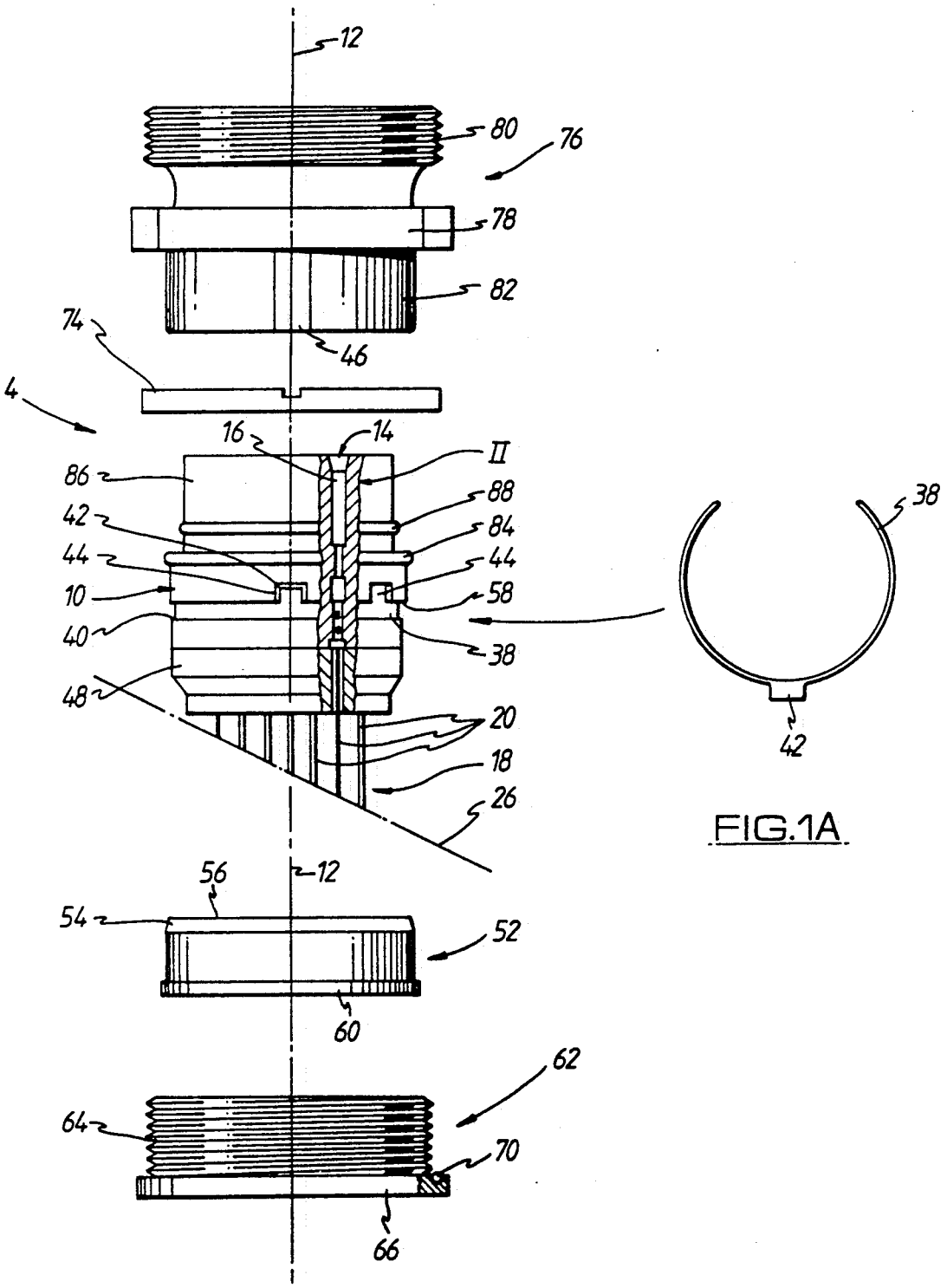
FIG. 1 is an exploded side view, partly in section, of a connector according to the invention together with securing parts.
FIG. 1A is a plan view of a slotted clamping ring utilized with the multiple connector shown in FIG. 1.

A connector 4 according to the invention comprises a contact holder 10 secured via securing parts (explained hereinafter) in sealing-tight manner in an opening in the wall 6 of the casing of a suitable control device 8 (see FIG. 3) in the form of a hermetically sealed lead-through. When used for the aforementioned purpose in underground working, it is essential for the connector according to the invention to be sealing-tight, since it is always necessary underground to work in an intrinsically safe region protected from explosion. The contact holder 10 has a number of contact chambers (37 in the embodiment) extending in the direction of the longitudinal axis 12 (FIG. 1) of the connector and parallel to one another through the contact holder 10 and each containing contact elements 16 which are peripherily sealed from the contact chambers 14, so that connecting pieces 18 of elements 16 project outwardly from one side of the contact-holder 10 In the embodiment shown, the contact elements 16 are elongate socket contact of substantially cylindrical cross-section, but corresponding plug pins can likewise be used according to the invention. A corresponding multipole plug (not shown) therefore will have either pins or sockets.

According to the invention the connecting pieces 18 of the contact elements 16 are in the form of parallel soldering tabs 20, or "soldering legs". By this means the connector 4 according to the invention can be connected in a single operation inside the device, in that, as shown in FIG. 4, the soldering pins 20 are inserted into openings 22 in one or more of the flexible circuit boards 24 and are then soldered in a single operation, more particularly in known manner in a soldering bath.

A number of circuit boards 24 are then successively mounted and soldered. In the process, various connections between the circuit boards 24 can be made via the soldering tabs 20 according to the invention, at the soldered joints.

Figure 4:
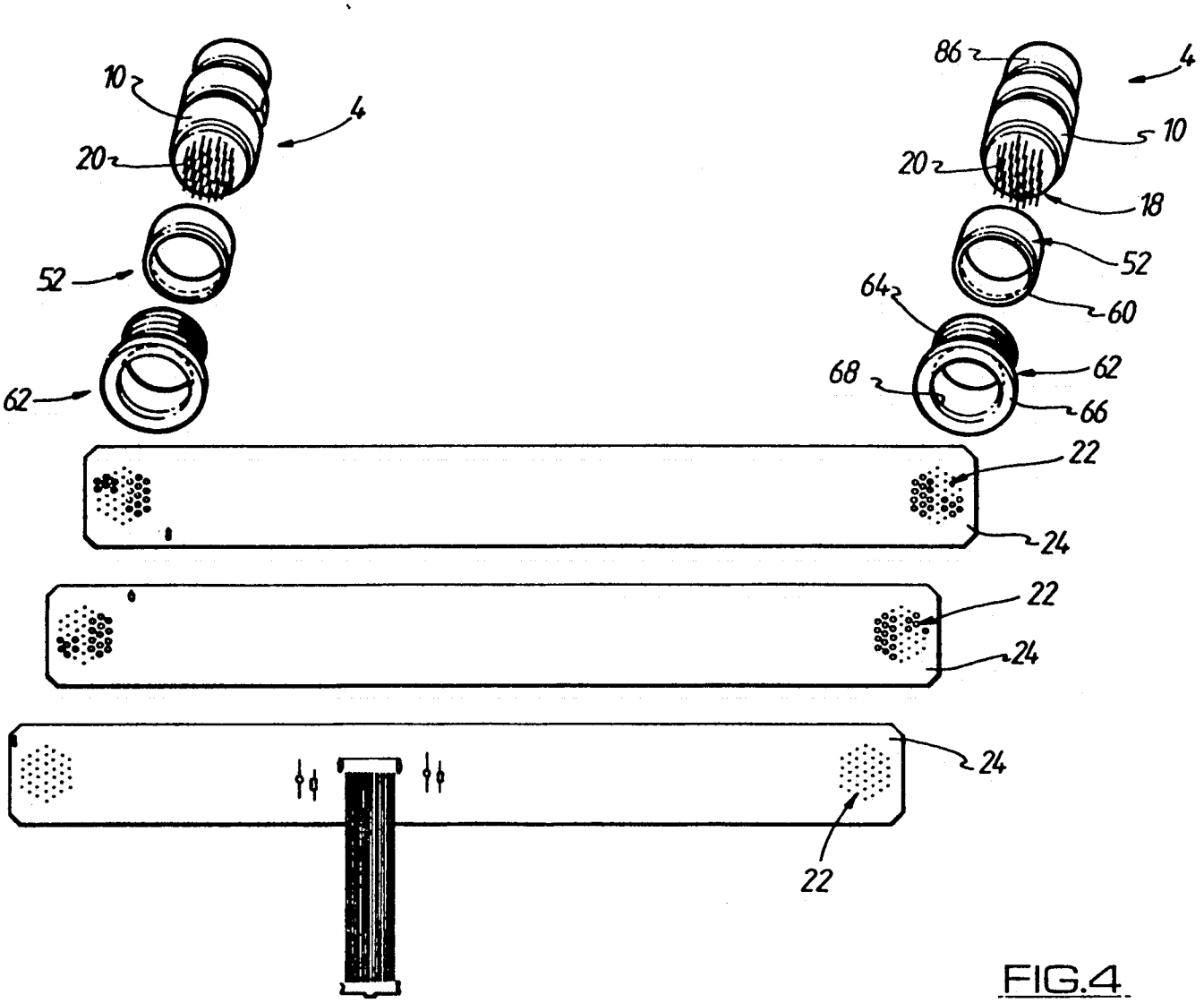
FIG. 4 is a perspective exploded view cf two connectors according to the invention, interconnected via flexible circuit boards.

In FIGS. 1 and 4, the soldering tabs 20 according to the invention project for various lengths beyond the contact holder 10. As shown in FIG. 1, the free ends of the soldering tabs 20 lie on a plane 26 situated at an angle to the longitudinal axis 12 of the connector. This greatly simplifies insertion of the soldering tabs 20 into the corresponding openings 22 in the circuit board 24.

Figure 2:
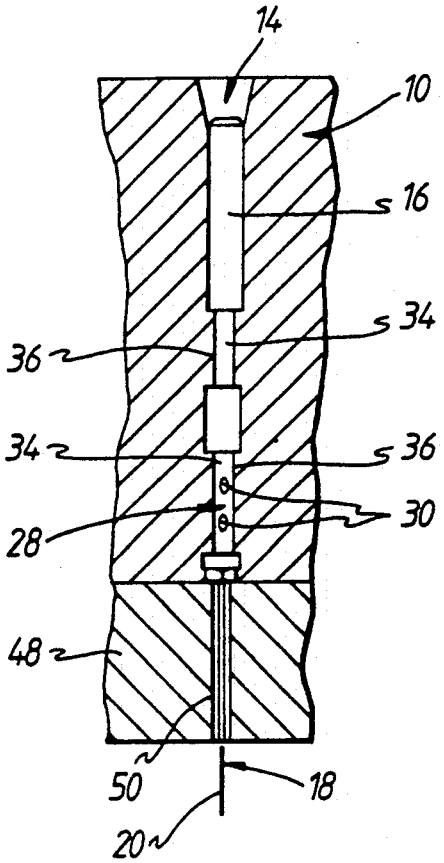
FIG. 2 is a larger-scale view of the region II shown in section in FIG. 1.

As shown particularly in FIG. 2, the soldering tabs 20 preferably comprise wires of circular cross-section and crimped to the contact elements 16. The wires are inserted into a sleeve-like crimping region 28 of the respective contact element 16 and are crimped in electrically conductive manner by embossing at 30.

After soldering, the tabs 20 are cut off in conventional manner immediately above the soldered joint, as shown in FIG. Advantageously also the entire soldered connecting region of the circuit board or boards 24 is covered by an insulating protective layer 32.

As shown more particularly from the sectional drawing in FIG. 2, each contact element 16 is peripherally sealed from the contact holder 10 or from the contact chamber 14 and is non-positively and/or positively held in the contact chamber 14, in that the contact holder 10 is made of a resilient material, preferably rubber, and the contact element 16 has at least one constriction 34 engaging an annular web 36 formed in the contact chamber 14. In the example shown, the contact element 16 has two axially spaced-apart constrictions 34 each engaging an annular web 36 formed in the contact chamber 14. In the embodiment of the invention shown, one constriction 34 is formed by the sleeve-like crimped region 28 of the contact element 16. As a result of the aforementioned construction, the contact elements 16 are very efficiently held in the respective contact chambers 14 and there is also excellent sealing in this region, so that the connector 4 according to the invention is particularly suitable for use in underground working as described.

The aforementioned holding and sealing effect can be improved according to the invention by a slotted clamping ring 38 (see FIG. 1A) which surrounds the substantially cylindrical contact holder 10 at least in the region of one of the constrictions 34 in the contact elements 16 or in the region of the annular webs 36 on the contact chambers 14. The clamping ring 38 is preferably resilient and is disposed in an annular groove 40 of the contact holder 10. In order to fit the contact elements 16 by axially sliding them into the contact chambers 16, chambers 16 can be resiliently radially expanded, e.g. by special pliers, owing to the elastomeric material of which the contact holder 10 is made. After all the contact elements 16 have been fitted, the radial expansion is prevented by the clamping ring 38 provided according to the invention, which is resiliently clipped on after assembly. Owing to its arrangement according to the invention, the clamping ring 38 more particularly ensures that the annular webs 36 are always held in engagement in the constrictions 34 in the contact elements 16.

In FIG. 1, the clamping ring 38, on its side remote from the soldering tabs 20 in the direction of the longitudinal axis 12 cf the connector, merges integrally into a positioning cam 42 extending radially outwards. Cam 42 is disposed in a recess 44 in the contact holder 10 axially adjacent the annular groove 40, and also in an axial slot 46 in one of the securing parts, to be described hereinafter. The positioning cam 42 prevents the contact holder 10 from twisting around its longitudinal axis 12. In addition, the positioning cams 42 keep the contact holder 10 in a defined relative rotary position in the respective casing. In order to vary this relative rotary position, according to another feature of the invention, the contact holder 10 has a number of recesses 44 (e.g. three) for the positioning cam 42 of the clamping ring 38, the recesses 44 each being disposed at certain places on the periphery of holder 10 corresponding to a desired contact position. The rotary or contact position of the connector 4 according to the invention can thus be obtained very easily and rapidly by "re-mounting" (twisting) the clamping ring 38.

As also shown by the section in FIG. 2, the contact holder 10 on the soldering-tab side is connected and has its surface adjacent to a disk-like piece 48, e.g. by adhesion or welding, and the end piece 48 has through openings 50 flush with the contact chambers 14 and only slightly larger in cross-section than the soldering tabs 20. The end piece 48 is secured to the contact holder 10 after all the contact elements 16 have been inserted into the contact chambers 14 in the previously-described manner. The end piece 48 thus helps to secure the contact elements 16, in that it substantially seals the contact chambers 14 up to the through openings 50 from the soldering-tab side.

Figure 3:
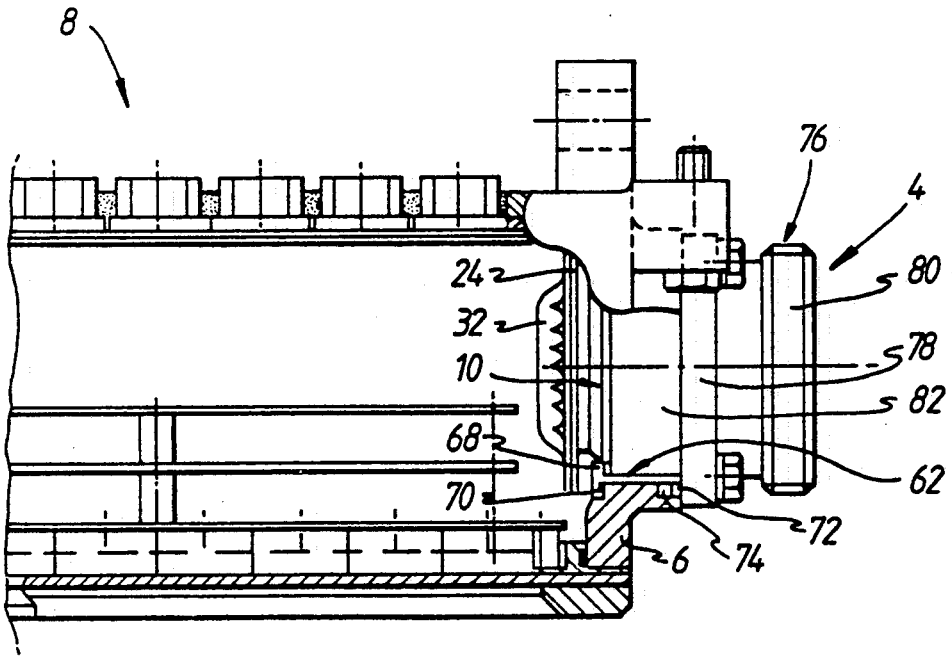
FIG. 3 is a side view, partly in section, of the connector according to the invention in the state when installed in a device.

FIGS. 1 and 4 also show a back-up ring 52 which surrounds the contact holder 10 in the region between the positioning cams 42 and the soldering tab-side end of the holder 10 including the clamping ring 38. In the assembled plate, the back-up ring 52 has a front annular surface 56 formed by an outer chamfer 54 and remote from the soldering tabs 20 and abutting an annular step 58 on the contact-holder 10 bounding one side of the annular groove 40 for the clamping ring 38. The end region of the back-up ring on the tab side has an outer annular web 60. Also, a securing ring 62 is provided with a threaded portion 64 which at one end has an annular web 66 and an inner annular web 68 (shown in FIG. 8 only). The securing ring 62 substantially constitutes a screw cap. As shown in FIG. 3, the threaded portion 64 when assembled extends through the opening in the casing wall 6, whereupon the outer annular web 60, via a sealing ring 70, abuts the edge of the opening in the casing wall 6, whereas the inner annular web 68 extends over the outer annular web 60 of the back-up ring 52 mounted on the contact-holder 10, and the threaded portion 64 of the securing ring 62 is screwed to the other side of the casing wall 6 by a threaded ring 74 (a threaded nut) preferably disposed in an annular groove 72 in the casing wall 6.

Another securing part is provided, i.e. a securing flange 70 which surrounds and seals the contact holder 10 and screws it against the casing wall 6. The securing flange 76 comprises a flange plate 78 which at one side is adjacent a threaded spigot 80 for connecting a plug (not shown) and at the other side is adjacent a thrust ring 82. In the assembled state, the thrust ring 82 extends through the opening in the casing wall 42 and engages an annular gap formed between the back-up ring 52 and the securing ring 62, upto the outer annular web 60 of the back-up ring 52. In this manner the contact holder 10 is firmly secured in absolutely sealing-tight manner in the casing wall 42. In the process, the axial slot 46 cooperating with the cam 42 for positioning the clamping ring 38 is formed in the thrust ring 82 of the securing flange 76.

As shown in FIG. 1, the contact holder 10 also has an integrally formed sealing ring 84 for sealing against the securing flange 76, and also its front reduced-diameter plug region 86 has an integrally formed sealing ring 88 for sealing against an annular part of a connecting plug (also not shown) and insertable into an annular gap (not shown) formed between the plug region 86 and the threaded spigot 80 of the securing flange 76.

The invention is not restricted to the embodiments illustrated and described, but includes all embodiments which are equivalent in the sense of the invention.

We claim:

1. A multipole connector adapted to be led in a sealed manner through an opening in a wall of a casing of a control device used for underground working, comprising a contact holder made of a resilient material, securing parts on the contact holder for securing the contact holder in a sealed manner in the opening in the wall, a plurality of contact chambers extending through the contact holder parallel to one another in the direction of the longitudinal axis of the connector, a plurality of contact elements in the contact chambers with each contact element having at least one constriction engaging an annular web formed in the respective contact chamber, connecting pieces in the form of parallel soldering tabs on the contact elements arranged to project outwards from one side of the contact holder for the purpose of making connections, a slotted clamping ring disposed in an annular groove in the contact holder and surrounding the contact holder in the region of the constructions in the contact elements and the annular webs of the contact chambers, a positioning cam on the slotted clamping ring being disposed on the one hand in a recess in the contact holder and on the other hand in an axial slot in one of the securing parts.

2. A multipole connector according to claim 1, wherein the soldering tabs comprises wires crimped to the contact elements.

3. A multipole connector according to claim 1, wherein the contact elements are peripherally sealed against the contact holder.

4. A multipole connector according to claim 1, wherein the contact holder has a plurality of recesses for the positioning cam of the clamping ring at defined places corresponding to a desired contact position on the periphery of the holder.

5. A multipole connector according to claim 1, wherein the contact holder, on the side of the soldering tabs, is connected to and in contact with the surface of a disk-shaped end member, the end member having lead-through openings in the line with the contact chambers and having a cross-section slightly greater than that of the soldering tabs.

6. A multipole connector according to claim 1, wherein the soldering tabs project for varying lengths from the contact holder.

7. A multipole connector according to claim 6, wherein the free ends of the soldering tabs end approximately on a plane disposed at an angle to the longitudinal axis of the multipole connector.

8. A multipole connector according to claim 1, wherein a back-up ring surrounds the contact holder in the region between the positioning cam and the soldering-tab side end of the holder including the clamping ring wherein, when the back-up ring is in the mounted state, the front annular edge thereof remote from the soldering tabs abuts an annular step on the contact holder bounding one side of the annular groove for the clamping ring, the region of the back-up ring on the side of the soldering pin having an outer annular web.

9. A multipole connector according to claim 8, having a securing ring like a screw cap which is provided with a threaded portion which, at one end, has an outer annular web and an inner annular web whereby, when the threaded portion is fitted, the threaded portion extends through the opening in the wall and the outer annular web bears via a sealing ring against the edge of that opening, the inner annular web extending behind the outer annular web of the back-up ring disposed on the contact holder, and the threaded portion of the securing ring being screwed to the other side of the casing wall by a threaded ring.

10. A multipole connector according to claim 8, having a securing flange surrounding the contact holder and screwed in a sealing-tight manner against the casing wall and having a flanged plate which, at one side, is adjacent a threaded spigot for connecting a plug and, at the other side, is adjacent a thrust ring whereby, when mounted, the thrust ring extends through the opening in the wall and engages in an annular gap formed between the back-up ring and the securing ring up to the annular web of the back-ring.

11. A multipole connector according to claim 10, wherein the contact holder has an integrally-formed sealing ring for sealing against the securing flange and, in a front reduced-diameter plug-in region thereof, has an integrally-formed sealing ring for securing against an annular part of a connecting plug for insertion into an annular gap formed between the plug-in region and the threaded spigot of the securing flange.

12. A multipole connector according to claim 10, wherein the axial slot co-operating with the positioning cam of the clamping ring is formed in the thrust ring of the securing flange.

* * * * *